US009827504B2

(12) United States Patent
Olson

(10) Patent No.: US 9,827,504 B2
(45) Date of Patent: Nov. 28, 2017

(54) VIBRATORY DEVICE FOR BOBBLE TOYS

(71) Applicant: Kenneth E. Olson, Clovis, CA (US)

(72) Inventor: Kenneth E. Olson, Clovis, CA (US)

( * ) Notice: Subject to any disclaimer, the term of this patent is extended or adjusted under 35 U.S.C. 154(b) by 130 days.

(21) Appl. No.: 13/801,685

(22) Filed: Mar. 13, 2013

(65) Prior Publication Data

US 2013/0309935 A1 Nov. 21, 2013

Related U.S. Application Data

(60) Provisional application No. 61/649,239, filed on May 19, 2012.

(51) Int. Cl.

| | |
|---|---|
| ***A63H 3/20*** | (2006.01) |
| ***A63H 33/26*** | (2006.01) |
| ***A63H 13/18*** | (2006.01) |

(52) U.S. Cl.

CPC ..... *A63H 3/20* (2013.01); *A63H 13/18* (2013.01); *A63H 33/26* (2013.01)

(58) Field of Classification Search

CPC ..... A63H 3/20; A63H 13/18; A63H 33/26
USPC ..... 446/330, 331, 352, 359
See application file for complete search history.

(56) References Cited

U.S. PATENT DOCUMENTS

| | | | |
|---|---|---|---|
| 2,000,332 | A | 5/1935 | Jensen |
| 2,606,397 | A | 8/1952 | Marchese |
| 2,614,362 | A | 10/1952 | Zavala |
| 2,614,363 | A | 10/1952 | Bowditch |
| 2,705,761 | A | 4/1955 | Unholtz |
| 3,062,041 | A | 11/1962 | Spodnewski |
| 3,167,670 | A | 1/1965 | Spurlin |
| 3,263,953 | A | 8/1966 | Shottenfeld et al. |
| 3,399,857 | A | 9/1968 | Schultz |
| 3,714,612 | A | 1/1973 | Kayle |

(Continued)

FOREIGN PATENT DOCUMENTS

| | | |
|---|---|---|
| CA | 2145437 A1 | 9/1996 |
| DE | 875319 C1 | 4/1953 |

(Continued)

OTHER PUBLICATIONS

Berkelman, L., Magnetic Levitation for Haptic Interaction, Mechanical Engineering Department, University of Hawai'l at Manoa, available online at http://www.me.hawaii.edu/HRIL/mag-lev.html.

(Continued)

*Primary Examiner* — Melba Bumgarner
*Assistant Examiner* — Joseph B Baldori
(74) *Attorney, Agent, or Firm* — Marcus N. DiBuduo; John R. Aaron

(57) ABSTRACT

Disclosed are vibratory devices for inducing movement to a bobble toy, such as a bobble head, without user interaction. The vibratory device has a platform upon which the bobble toy rests, a base supporting the platform, springs and/or bearings supporting the platform, and magnetic vibration means. The magnetic vibration means include electromagnets, permanent magnets, and/or ferromagnetic materials. The electromagnetics can be controlled by hardware, software, and user inputs, and may be programmable or controllable by a computer, a mobile phone, or a remote. Multiple vibratory devices may be programmed or coupled to provide synchronized vibratory motion.

38 Claims, 14 Drawing Sheets

(56) References Cited

U.S. PATENT DOCUMENTS

| | | | | |
|---|---|---|---|---|
| 3,945,640 | A | 3/1976 | Denmark | |
| 3,967,410 | A | 7/1976 | Hodska | |
| 3,969,837 | A | 7/1976 | Kresse | |
| 3,974,593 | A | 8/1976 | Walker, Jr. | |
| 4,040,206 | A | 8/1977 | Kimura | |
| 4,206,567 | A | 6/1980 | Cieslak | |
| 4,233,777 | A | 11/1980 | Inoue | |
| 4,448,416 | A * | 5/1984 | Belter | A63F 7/386 273/110 |
| 4,571,198 | A | 2/1986 | Barbato et al. | |
| 4,573,940 | A | 3/1986 | Showers | |
| 4,578,044 | A * | 3/1986 | Saitoh | 446/134 |
| 4,595,166 | A | 6/1986 | Kurokawa | |
| 4,673,369 | A | 6/1987 | DiPietro | |
| 4,694,599 | A | 9/1987 | Hart et al. | |
| 4,775,863 | A | 10/1988 | Jaki et al. | |
| 4,823,490 | A | 4/1989 | Jaki et al. | |
| 4,852,283 | A | 7/1989 | Teng | |
| 4,875,886 | A | 10/1989 | Sung | |
| 4,878,873 | A | 11/1989 | Yamaguchi et al. | |
| 4,878,878 | A | 11/1989 | Bittner | |
| 5,003,714 | A | 4/1991 | Satoh et al. | |
| 5,011,449 | A | 4/1991 | Handy et al. | |
| 5,024,611 | A | 6/1991 | Eckerle et al. | |
| 5,050,876 | A * | 9/1991 | Chuang | 273/456 |
| 5,099,216 | A | 3/1992 | Pelrine | |
| 5,135,425 | A | 8/1992 | Andrews et al. | |
| 5,144,176 | A | 9/1992 | Popper | |
| 5,152,711 | A | 10/1992 | Gross | |
| 5,178,573 | A | 1/1993 | Smith | |
| 5,337,077 | A | 8/1994 | Browne | |
| 5,360,366 | A * | 11/1994 | Lin | 446/134 |
| 5,370,569 | A | 12/1994 | Mo-Hsin | |
| 5,412,890 | A * | 5/1995 | Fechter | 40/414 |
| 5,417,605 | A | 5/1995 | Chan | |
| 5,433,643 | A | 7/1995 | Pratt | |
| 5,451,180 | A | 9/1995 | Chan et al. | |
| 5,793,349 | A | 8/1998 | Browne | |
| 5,807,112 | A | 9/1998 | Zeck | |
| 5,865,516 | A * | 2/1999 | Woy | 312/125 |
| 5,883,454 | A | 4/1999 | Hones et al. | |
| 5,967,470 | A | 10/1999 | Guschlbauer | |
| 5,984,757 | A | 11/1999 | Tsai | |
| 6,025,825 | A | 2/2000 | Kao | |
| 6,106,360 | A | 8/2000 | Jenkins et al. | |
| 6,111,759 | A | 8/2000 | Tijanic et al. | |
| 6,165,038 | A | 12/2000 | Muller | |
| 6,193,579 | B1 | 2/2001 | Mak | |
| 6,264,525 | B1 | 7/2001 | Guschlbauer | |
| 6,272,778 | B1 | 8/2001 | Tang | |
| 6,361,395 | B1 | 3/2002 | Pacza | |
| 6,422,916 | B1 | 7/2002 | Enku | |
| 6,511,359 | B1 | 1/2003 | Lui | |
| 6,543,289 | B1 | 4/2003 | Jinzenji et al. | |
| 6,568,272 | B2 | 5/2003 | Fukushima et al. | |
| 6,568,986 | B2 | 5/2003 | Kobayashi | |
| 6,601,326 | B1 | 8/2003 | Bublitz et al. | |
| 6,682,392 | B2 * | 1/2004 | Chan | 446/335 |
| 6,729,930 | B1 | 5/2004 | Lui | |
| 6,810,611 | B2 | 11/2004 | Yarnall | |
| 6,814,646 | B2 | 11/2004 | Atobe et al. | |
| 6,817,921 | B2 | 11/2004 | Chin et al. | |
| 6,853,283 | B1 | 2/2005 | French | |
| 6,923,707 | B2 | 8/2005 | Dancer | |
| D512,753 | S | 12/2005 | Mills | |
| D518,860 | S | 4/2006 | Bishop | |
| 7,025,653 | B1 | 4/2006 | Hawkins | |
| 7,029,360 | B1 | 4/2006 | Hawkins | |
| 7,048,605 | B2 * | 5/2006 | Hawthorne et al. | 446/358 |
| 7,063,588 | B2 | 6/2006 | Kaneko et al. | |
| 7,140,943 | B1 | 11/2006 | Hawkins | |
| 7,234,207 | B2 | 6/2007 | Goldberg | |
| 7,268,672 | B2 | 9/2007 | King | |
| 7,318,766 | B2 * | 1/2008 | Marine et al. | 446/359 |
| 7,348,691 | B2 | 3/2008 | Davis et al. | |
| 7,602,130 | B2 | 10/2009 | Tu et al. | |
| 7,628,672 | B2 | 12/2009 | Hoeting et al. | |
| 7,695,340 | B2 | 4/2010 | Nakazato et al. | |
| 7,815,485 | B2 * | 10/2010 | Moothedath et al. | 446/352 |
| 7,837,531 | B2 | 11/2010 | Friedland et al. | |
| 7,971,376 | B2 * | 7/2011 | Tsao | 40/423 |
| 8,382,550 | B2 * | 2/2013 | Kang | 446/359 |
| 2005/0112984 | A1 * | 5/2005 | Hawthorne et al. | 446/21 |
| 2006/0154217 | A1 | 7/2006 | Pachler | |
| 2007/0037475 | A1 * | 2/2007 | Spear | 446/330 |
| 2007/0037476 | A1 * | 2/2007 | Leslie | 446/376 |
| 2008/0301985 | A1 * | 12/2008 | Tsao | 40/423 |
| 2009/0203291 | A1 * | 8/2009 | Rehkemper et al. | 446/330 |
| 2011/0014848 | A1 | 1/2011 | Law | |
| 2013/0309935 | A1 * | 11/2013 | Olson | 446/330 |

FOREIGN PATENT DOCUMENTS

| | | | |
|---|---|---|---|
| DE | 898423 | C1 | 11/1953 |
| EP | 1008374 | A2 | 6/2000 |
| GB | 781092 | A | 8/1957 |
| WO | 2001017630 | A2 | 3/2001 |
| WO | 2004013948 | A1 | 2/2004 |
| WO | 2010127572 | A1 | 11/2010 |

OTHER PUBLICATIONS

Beebe, S.F., and Lowe, A., Electromagnetic Game, English Abstract of Canadian Patent Publication CA2145437, Sep. 25, 1996, European Patent Organization, http://www.epo.org/searching/free/espacenet.html.

Hung, C.N., Rotating Magnetic Levitation Device and Method for Magnetically Levitating Top, English Abstract of World Intellectual Property Organization Patent Publication WO2010127572, Nov. 11, 2010, European Patent Organization, http://www.epo.org/searching/free/espacenet.html.

Barcelo, R.G., Reduced-Consumption Dynamic Magnetic Motor, English Abstract of World Intellectual Property Organization Patent Publication WO2004013948, Feb. 12, 2004, European Patent Organization, http://www.epo.org/searching/free/espacenet.html.

* cited by examiner

VIBRATORY DEVICE FOR BOBBLE TOYS

RELATED APPLICATIONS

This application claims the benefit of U.S. Provisional Patent Application No. 61/649,239, filed May 19, 2012, incorporated herein by reference in its entirety.

FIELD OF THE INVENTION

The present invention concerns apparatuses and systems for imparting vibrational movement to a bobble toy. More specifically, some embodiments of the present invention pertain to electromagnetically operated apparatuses and systems for vibrating a platform upon which a bobble toy rests.

BACKGROUND OF THE INVENTION

Conventional bobble toys, such as bobblehead dolls, nodders, and wobblers, include two or more rigid portions which are operatively engaged to another with one or more springs. This permits a first rigid portion (e.g., a head) to move in relative independence from a second rigid portion (e.g., a body) such that an impact to the first body portion (e.g., a tap) will cause the second body portion to "bobble" or swing back and forth. Typical bobble toys have a base portion and a top portion, where the base has a flat surface for resting on a table or other supporting device and the top, operatively engaged to the base with a spring, is free to bobble when an impact force is applied to the base or top.

In some conventional applications, the base of a bobble toy may be mounted on an automobile dashboard causing the top of the toy to bobble when the car is in motion. In some other conventional applications, the base of a bobble toy may be placed on a stationary surface and a user may impart an impact force to the top of the bobble toy causing the top of the toy to exhibit pendulum motion.

Some conventional bobble toys further include mechanical means for applying an impact force to one of the rigid body portions, giving the toy the appearance of autonomous movement. There also exist some conventional mechanical devices having a vibrating table upon which the bobble toy can be placed. The conventional mechanical devices can be placed on a solid surface and activated, permitting the bobble toy to be operated without interaction from the user. However, conventional approaches utilize motors, gears, actuators, pendulums, and similar mechanical devices which require a physical connection between the motion imparting means (such as a motor) and the rigid body portion of the bobble toy and/or the vibrating table. Such conventional approaches suffer from mechanical or contact wear and tear. Noise, caused by the mechanical implements, may also be present when using such devices. In addition the range of movement that can be imparted to the bobble toy is limited by the specific mechanical construction (i.e., it can move front to back, side to side, or up and down), and customization of the movement is not possible.

It is therefore desirable for apparatuses and systems for imparting motion to a bobble toy which are contactless and programmable.

SUMMARY OF THE INVENTION

Several embodiments of the present invention relate to electromagnetically operated apparatuses and systems for vibrating a platform upon which a bobble toy rests. More specifically, disclosed are devices which include one or more electromagnetic devices each for imparting magnetic attractive and repulsive force on a platform upon which the bobble toy may rest.

In some aspects, the invention concerns a vibratory device for imparting motion to a bobble toy which may include a base having one or more base magnetic members therein; a platform for supporting the bobble toy having one or more platform magnetic member(s) engaged therewith; and one or more support spring(s) for supporting the platform. The platform magnetic members may be disposed adjacent to the at least one base magnetic member. The support springs may be between the base and a bottom surface of the platform.

In some embodiments, the base magnetic member(s) may include at least one electromagnet operable to displace the platform magnetic member(s). The platform magnetic member(s) may include a rare earth magnet, a permanent magnet, or a ferromagnetic material, or the platform magnetic member(s) may include at least one electromagnet. In some other embodiments, the base magnetic member(s) may include a rare earth magnet, a permanent magnet, or a ferromagnetic material, and the platform magnetic member(s) may include at least one electromagnet operable to displace the platform magnetic member(s).

In some embodiments, apparatuses can include at least two base magnetic members and at least two platform magnetic members. The base magnetic members and the platform magnetic members may be adjacent and/or aligned with one another.

In some embodiments, apparatuses can include control circuitry adapted to activate and deactivate the electromagnet(s). The control circuitry may activate and deactivate the electromagnet in one or more patterns. In some embodiments, a configuration device (for example, and without limitation, a button, switch, or dial) can be coupled to the control circuit. In some embodiments, a port (for example, and without limitation, a USB port or a wireless transceiver) can be coupled to the control circuit. In some implementations, an external stimuli sensor (for example, and without limitation, an audio sensor or a light sensor) can be coupled to the control circuit. The configuration device, port, and/or sensor may operate with the control circuitry to activate and deactivate the electromagnet, in some embodiments, according to one or more pattern(s).

In some embodiments, the bobble toy may be detatchably engaged to the platform. In some other embodiments, the bobble toy may include the platform (i.e., the platform may be integrally formed with the base of the bobble toy), and the platform magnetic member may be included in the bobble toy.

In some embodiments, apparatuses can include bearing(s) and/or spring(s) for supporting the platform. The bearing(s) and/or spring(s) may be between the base and a bottom surface of the platform. In some implementations, the bearing may be positioned in about the center of the base, and the spring(s) may be positioned at distal ends of the base. The bearing may be about equidistant from each of the base magnetic member(s) and about equidistant from each of the support spring(s).

In some aspects, the invention concerns a vibratory device for imparting motion to a bobble toy that may include: a platform for supporting the bobble toy; a base supporting the platform; a first plurality of magnetic members engaged with the platform; a second plurality of magnetic members in the base; a plurality of support springs supporting the platform; and a bearing for supporting the platform. The second plurality of magnetic members may include at least one electromagnet. First ends of the support springs may engage the base and second ends of the support springs may engage the platform. The bearing may be between the base and a bottom surface of the platform. The apparatus may include a fastener for securing the bobble toy to the platform. In some embodiments, each of the first plurality of magnetic members may be aligned with one of the second plurality of magnetic members.

In some embodiments, the bearing may be positioned in about the center of the base. The bearing may be about equidistant from each of the second plurality of magnetic members and may be about equidistant from each of the plurality of support springs.

In some embodiments, the apparatus may further include control circuitry adapted to selectively activate and deactivate the at least one electromagnet. One or more configuration device(s) (for example, and without limitation, a button, switch, or dial) may be coupled to the control circuitry for selecting a pattern in which the electromagnet (s) are selectively activated and deactivated. One or more speaker(s) may be coupled to the control circuitry, and the configuration device(s) may further select a pattern of sound emitted from the speaker(s). One or more light source(s) may be coupled to the control circuitry, and the configuration device(s) may further select a pattern of light emitted from the light source(s). The platform and/or the base may include openings, reflective materials, and/or translucent materials for reflecting or passing light emitted from the light source(s). In some embodiments, the apparatus can include one or more sensor(s) (for example, and without limitation, audio or light sensors) for detecting external stimuli that may be coupled to the control circuitry.

In some embodiments, the apparatus can include one or more port(s) (for example, and without limitation, a USB port or a wireless transceiver) coupled to the control circuitry. The port may provide electronic communication between the control circuitry and an external electronic device (for example, and without limitation, a computer, a mobile phone, or a remote control). The control circuitry may include a processor and a memory element. The memory element may store instructions for the processor to selectively activate and deactivate the electromagnet(s) according to at least one pattern.

In some aspects, a system for automating vibration of a bobble toy may include at least one vibratory device. Each vibratory device may include: a platform for supporting the bobble toy; a base supporting the platform; and control circuitry. In some embodiments, the platform may have a magnetic member engaged therewith, and the base may have an electromagnet therein. The electromagnet may be adjacent to the magnetic member of the platform. The control circuitry may selectively activate and deactivate the electromagnet to induce a pattern of vibration of the platform relative to the base.

In some embodiments, the vibration pattern of the platform may be selected from a plurality of vibration patterns by operation of a configuration device (for example, and without limitation, a button, switch, or dial) coupled to the control circuitry. In some embodiments, the vibration pattern of the platform may be selected from a plurality of vibration patterns through a port (for example, and without limitation, a USB port or a wireless transceiver) coupled to the control circuitry.

In some embodiments, a system can have two or more vibratory devices, and the control circuitry of a first vibratory device may be coupled to the control circuitry of the second vibratory device. In some implementations, the control circuitry of the first vibratory device may select a vibration pattern of the second vibratory device.

In some embodiments, the vibratory device may include one or more light source(s), and the control circuitry may activate and deactivate the light source(s) according to at least one pattern. In some embodiments, the vibratory device may include one or more speaker(s), and the control circuitry may activate and deactivate the speaker(s) according to at least one pattern. In some embodiments, the vibratory device may further include one or more sensor(s) (for example, and without limitation, audio sensors or light sensors) coupled to the control circuitry for detecting external stimuli.

These and other objects, advantages and features of the invention, together with the organization and manner of operation thereof, will become apparent from the following detailed description when taken in conjunction with the accompanying drawings, wherein like elements have like numerals throughout the several drawings described herein.

DETAILED DESCRIPTION OF PREFERRED EMBODIMENTS

The invention, in its various aspects, will be explained in greater detail below. While the invention will be described in conjunction with several exemplary embodiments, the exemplary embodiments themselves do not limit the scope of the invention. Similarly, the exemplary illustrations in the accompanying drawings, where like elements have like numerals, do not limit the scope of the exemplary embodiments and/or invention. Rather the invention, as defined by the exemplary claims, may cover alternatives, modifications, and/or equivalents of the exemplary embodiments.

Figure 1:
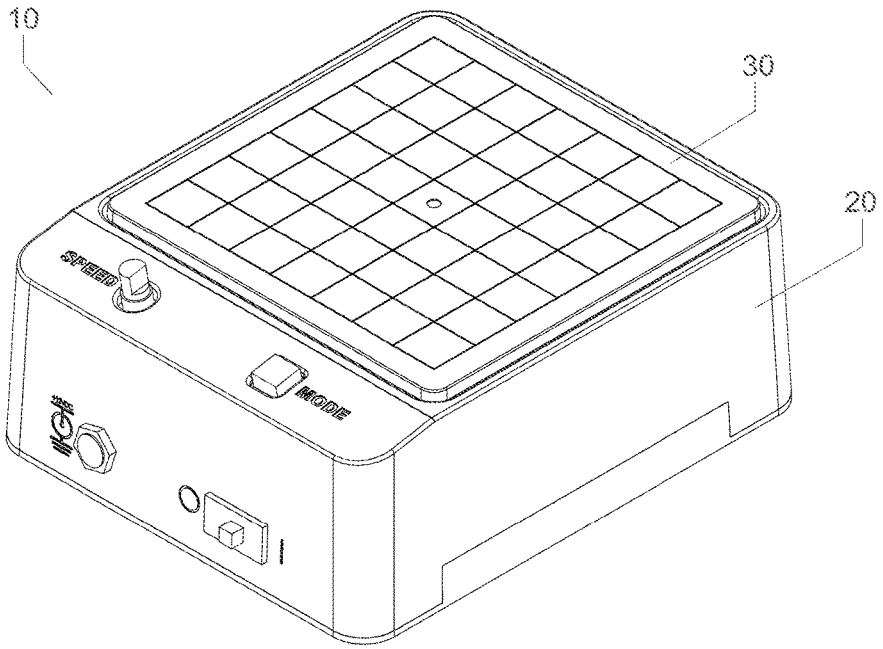
FIG. 1 is a perspective view diagram illustrating an exemplary vibratory device in accordance with some embodiments of the present invention.
Figure 14:
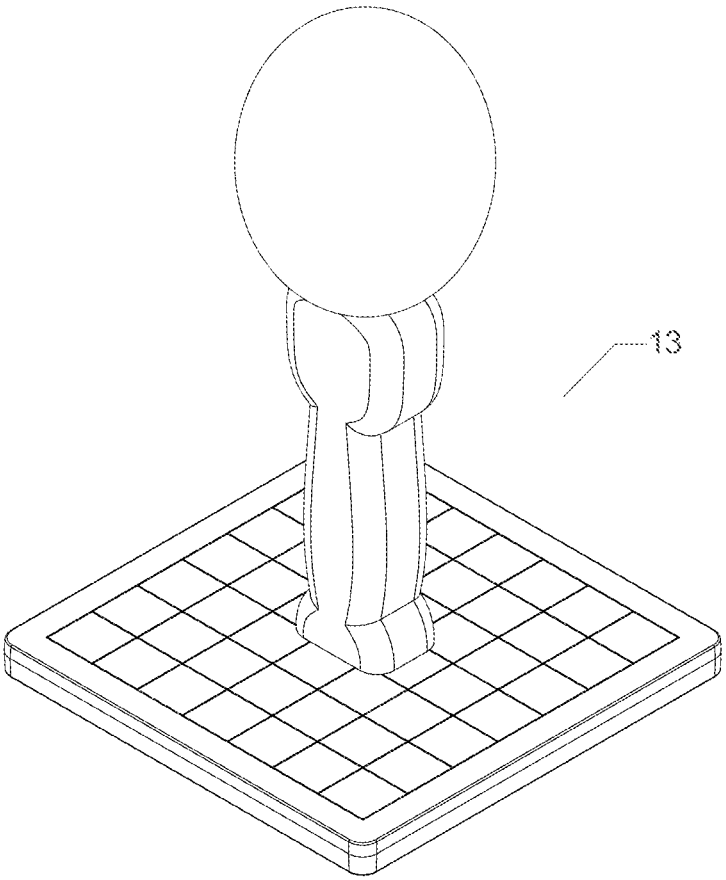
FIG. 14 is a perspective view diagram illustrating an exemplary bobble toy in accordance with some embodiments of the present invention.

Referring generally to FIGS. 1-14, and specifically to FIG. 1, it can be seen that vibratory devices in accordance with preferred embodiments of the present invention can include a plurality of sections. Vibratory device 10 can include base 20 and vibration platform 30. In some embodiments, vibration platform 30 may be positioned over base 20 in an opening for receiving the vibration platform 30 such that a bobble toy (not shown) may be placed on an upper surface of the vibration platform 30. In some embodiments, and as illustrated in the example of FIG. 14, bobble toy 13 may include an integrated platform. In such integrated platform embodiments, it is to be appreciated that the bobble toy itself may include one or more magnets on a bottom portion thereof for interaction with the magnetic elements of the base. The base and the platform may comprise any number of materials, for example and without limitation, wood, plastic, rubber, glass, crystal, metal, or combinations thereof. In some non-limiting implementations, the base and/or the platform may have areas on which a nametag or a faceplate can be affixed, which can provide personalization or congratulatory messages (such as the owners name or an award placard).

The platform may be a rigid structure that rests horizontally over the base. For example, and without limiting the invention, FIG. 1 shows a rigid square platform 30 having rounded edges. Platform may be a rigid plastic material such as polycarbonates, polyvinylchloride [PVC], acrylonitrile butadiene styrene [ABS], etc. In other non-limiting examples, the platform may comprise other rigid materials such as metals, glass, crystal, wood, and/or other materials. In further non-limiting embodiments, the platform may comprise a membrane-like structure comprising a flexible material. For example, and without limiting the invention, the platform may include a rubber layer (e.g., having a thickness in a range of about 1/32 in. to about 1/8 in.) having some flexibility (e.g., having a Shore A value in a range of about 10 to about 60). It is to be appreciated that the present invention includes platforms comprising other materials, and having other thicknesses and flexibilities.

Figure 2:
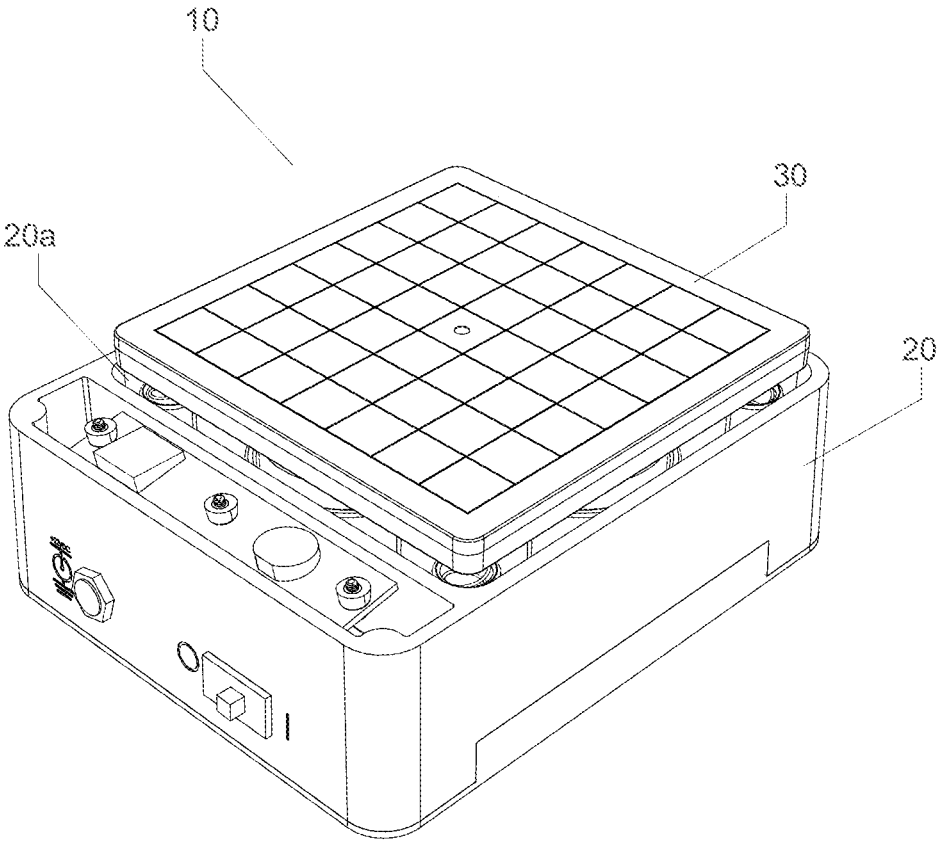
FIG. 2 is a perspective view diagram illustrating an exemplary vibratory device in accordance with some embodiments of the present invention.

It is to be appreciated that platform 30 may have dimensions that are less than dimensions of the opening of base 20 in which platform 30 is positioned such that platform 30 is flushly mounted to base 20. In some implementations, there may be a void between outside peripheral edges of platform 30 and inside edges of base 20. As an example and without limiting the invention, FIG. 2 shows a void **20*a* between the vibration platform 30 and the opening in base 20. In some embodiments, and without limitation, dampening means (e.g., foam or rubber) may be inserted between in void 20*a*** the peripheral edges of the platform and the inside edges of the base, which may dampen the vibration of the platform and may also provide an environmental seal preventing debris from falling into an inside cavity of the base. In some embodiments, bellows or deformable covers or skirts may be provided between the peripheral edges of the platform and the edges of the base to environmentally seal the vibratory device.

In some implementations, and without limitation, the base may have a square or rectangular shape (see, e.g., base 20 in FIG. 1). However, it is to be appreciated that bases having other shapes are contemplated in accordance with some embodiments of the present invention, for example and without limitation, circular, oval, triangular, polygonal (pentagonal, hexagonal, etc.), star-shaped, Reuleaux shapes, and other shapes. In some non-limiting implementations, the platform may be square and may have a size that is approximately the size of the upper opening in the base (see, e.g., platform 30 and base 20 in FIG. 1). However, it is to be appreciated that platforms having other shapes and sizes are contemplated in accordance with some embodiments of the present invention, for example and without limitation, circular, oval, triangular, polygonal (pentagonal, hexagonal, etc.), star-shaped, Reuleaux shapes, and other applicable shapes. In some embodiments, the platform and the base may have similar or complementary shapes. However, it is to be appreciated that they may have different shapes.

Figure 6:
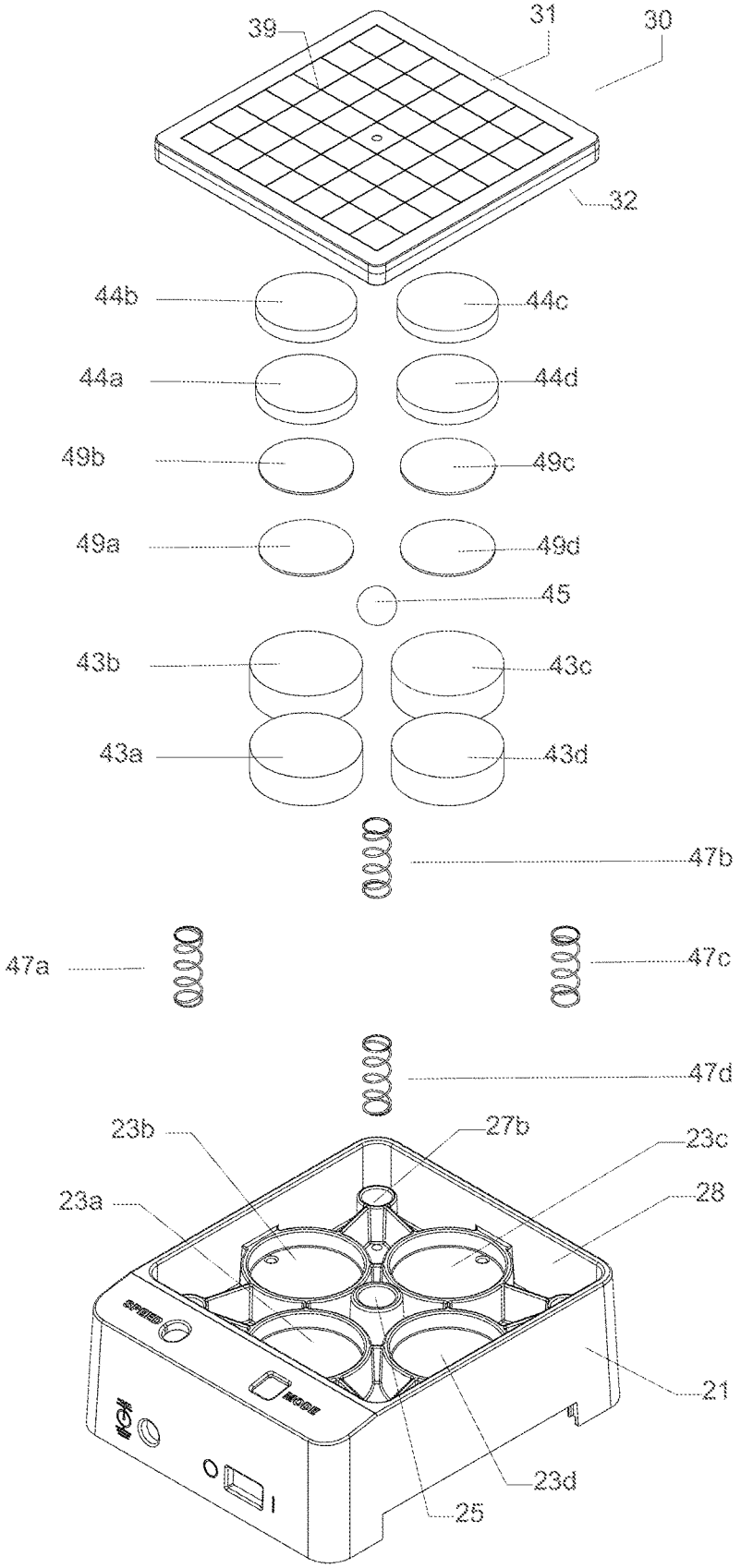
FIG. 6 is an exploded top perspective view diagram of an exemplary vibratory device in accordance with some embodiments of the present invention.

In some embodiments, the top surface of the platform may have features for securing the bobble toy. For example and without limiting the invention, the top surface of the platform may have gripping (for example, and without limitation gripping 39 on top surface 31 as shown in the illustration of FIG. 6) such as texturing, recesses, stippling, adhesive, touch fasteners (e.g., fabric hook and loop fasteners, hook and pile tape, Velcro®, etc.), double stick tape, materials with a high coefficient of friction (e.g., rubber), or other securing means for securing the bobble toy. In other non-limiting implementations, the top surface of the platform may have pegs, locks, slots, or other mechanical means for releasably engaging and restraining the bottom surface of the bobble toy. For example, and without limitation, the top surface of the platform may have a moveable clamp for engaging one or more sides of the base of the bobble toy. The clamp may have removable or adjustable ends such that the clamp can be used to secure bobble toys having square, rectangular, oval, circular, or irregular shapes. In some other non-limiting implementations, the bobble toy may be magnetically attached to the platform. For example, and without limitation, the platform may include a ferromagnetic plate and one or more rare earth magnets may be affixed to a bottom surface of the bobble toy. In other non-limiting embodiments, the platform may include mechanical attachment or engagement means for two or more bobble toys.

It is to be appreciated that, in accordance with some embodiments of the present invention, the vibration platform may move in relative independence from the base. For example, and without limitation, platform 30 may tilt side-to-side or front-to-back relative to base 20. In some other examples, platform 30 may rotate relative to base 20. In some embodiments, the vibratory device may include one or more controls or ports located on a top and/or side surface of the base. In some embodiments, the vibratory device may include wired, wireless, and optical communication ports for connection to computers, mobile phones, remote controls, other vibratory devices, optical and/or acoustical accessories, or other devices. For example, and without limitation, a vibratory device may include one or more USB ports, network ports, audio jacks, serial ports, parallel ports, transceivers for wireless data exchange over short distances using short wavelength radio transmissions (e.g., Bluetooth®), wireless local area network transceivers, and infrared ports. In some non-limiting implementations, the vibratory device may also include audio speakers, microphones, sensors, or display lighting.

Figure 3:
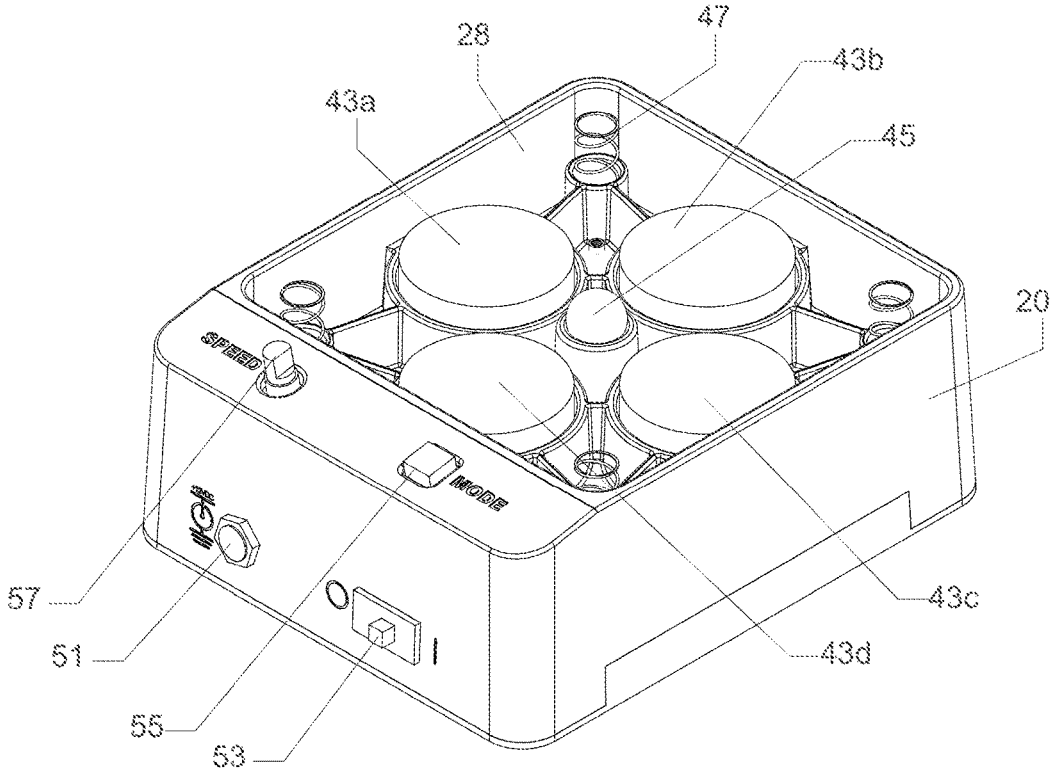
FIG. 3 is a perspective view diagram showing an exemplary vibratory device in accordance with some embodiments of the present invention, wherein a platform has been removed.

It is to be appreciated that vibratory devices in accordance with several preferred embodiments of the present invention enable vibration that can be programmable, customizable, responsive to external input, and/or synchronized with other vibratory devices and accessories. In some embodiments, a multifunction button can cycle the vibration table through various patterns. As a non-limiting example, FIG. 3 shows a vibratory device having a mode button 53 operable to change the vibrational pattern of the platform 30 and bobble toy installed thereon. For example, and without limitation, the vibratory device can come preconfigured with multiple motion patterns: side-to-side, front-to-back, circular, up and down (popping), swaying (e.g., where the front two corners of the platform are depressed toward the base in an alternating pattern), and other patterns. In some preferred embodiments, the platform may be configured with a pattern of vibration via software on a computer, an application on a mobile device, or other software program on an external device. In some embodiments, software may communicate with the vibratory device through a port for communication (for example, and without limitation, a USB or a serial port). The software and/or application may enable the user to create vibration patterns and download them to the vibratory device or control the vibration in real time. In some implementations, and without limitation, the software or applications may enable the user to stream or send vibration instructions to the vibratory device, which may be synchronized with audio, video, or other media playing on the computer or mobile device. In some embodiments, software profiles may be provided that correspond to specific bobble toys. For example, and without limitation, a user can apply one software profile to a bobble head toy representing a professional athlete and another software profile to an animal bobble head toy. In some embodiments, the software profiles may be included on a memory device (for example, and without limitation, a flash memory drive) and may be transferred to the vibratory device through a drive port therein. The profiles may be provided by the bobble toy manufacturer or may be designated in a common profile repository. Thus, the vibrational pattern of the platform may be externally controlled by a variety of external electronic device.

In some embodiments, the vibratory device may be responsive to ambient sound or light. For example, and without limitation, the vibratory device may include a microphone or optical sensor for detecting sound, motion, and/or light and may cause the platform to vibrate in response thereto.

Vibratory devices in accordance with some embodiments of the present invention may also communicate with other nearby vibratory devices. For example, and without limitation, a plurality of vibratory devices can be placed near each other and may communicate with each other to synchronize pattern of platform vibrations and thus the bobble toy movement. In some non-limiting implementations, multiple vibratory devices can be physically and/or electrically connected to each other and/or a computer or remote device.

It is to be appreciated that any number of features of the vibratory devices in accordance with some embodiments of the present invention may be programmable. For example, and without limitation, a vibratory device can be programmed with a sequence of different lights, sounds, and vibratory patterns. The vibrational pattern of the platform may be synchronized with the pattern of lights and/or sounds emitted by the vibratory device. For example, and without limiting the invention, one or more electromagnets in a base of the vibratory device may be activated and/or deactivated by a control circuitry each time a light source is turned on by the control circuitry. In a further example, and without limitation, the control circuitry may activate one or more speakers to play a particular song or musical melody, and synchronize the vibration of the platform with the melody or another aspect or pattern of the song. In some other examples, a plurality of vibratory devices can be arranged in a line, and the group of vibratory devices can be programmed to exhibit chasing lights and synchronized vibratory patterns. In one non-limiting example, multiple vibratory devices can be arranged so that they appear to each be dancing in a group to a melody played through the speakers. It is to be appreciated that other variations of patterns and synchronizations are contemplated in accordance with some embodiments of the present invention.

It is to be appreciated that any number of features of vibratory devices in accordance with some embodiments of the present invention may be responsive to external stimuli, such as sounds, motion, and light. For example, and without limiting the invention, the vibratory device may include a motion sensor that initiates a vibrational pattern in the platform when nearby motion is detected. In another example, and without limiting the invention, the vibratory device may include a microphone or other sound sensor that can trigger the control circuitry to initiate vibration of the platform when it detects a specific ambient sound, such as a specific word (e.g., "go") or the sound of hands clapping.

It is to be further appreciated that any number of features of vibratory devices in accordance with some embodiments of the present invention may include an alarm clock or timer feature as part of said control circuitry that can be set to activate the vibration of the platform at one or more set times. In such embodiments, speakers may be activated to emit music or other sounds (e.g., a buzzer), and/or light sources may activated to emit a light pattern with the vibrations of the platform in a synchronized manner at the one or more set times.

Referring now specifically to the non-limiting exemplary illustration of FIG. 3, which shows a vibratory device 10 with the platform removed, it can be seen that the base may include a cavity for housing an apparatus or mechanism for imparting motion to the platform. In preferred non-limiting implementations, base 20 may include top cavity 28 where housing springs 47, magnetic members 43*a-d*, and bearing 45 may be positioned. In preferred embodiments of the present invention, magnetic members engaged with the base may cooperate with magnetic members engaged with the platform to induce vibrational movement to the platform, such movement which may be hinged at a central bearing. In some embodiments, the vibration may be dampened by one or more springs, dampeners, bellows, and/or skirts between the base and the platform. One or more magnetic members engaged with the platform (for example and without limitation, magnetic members 44*a-d* as illustrated in FIG. 6) may react to the magnetic members engaged with the base (for example and without limitation, magnetic members 43*a-d* as illustrated in FIG. 6). In some embodiments, the magnetic members in the base may be aligned with the magnetic members engaged with the platform. For example, each magnetic member 43*a-d* is aligned with a corresponding magnetic member 44*a-d* engaged with the platform. However in some other embodiments, and discussed below, one or more of the magnetic members in the base may not be aligned with magnetic members engaged with the platform. For example referring to FIGS. 9-11, and without limitation, magnetic members 143*a-i* may be evenly spaced within evenly spaced magnetic recesses 123*a-i* in top cavity 128, while platform magnetic members (not shown) may be non-evenly spaced within non-evenly spaced magnetic recesses 134*a-i* in platform 130. It is to be appreciated that when the base and platform magnetic members are not evenly spaced, activation and deactivation of the electromagnets may cause the platform to rotate clockwise or counterclockwise relative to a central axis (for example, and without limitation, axis formed by bearing 145 in cavity 125).

Figure 9:
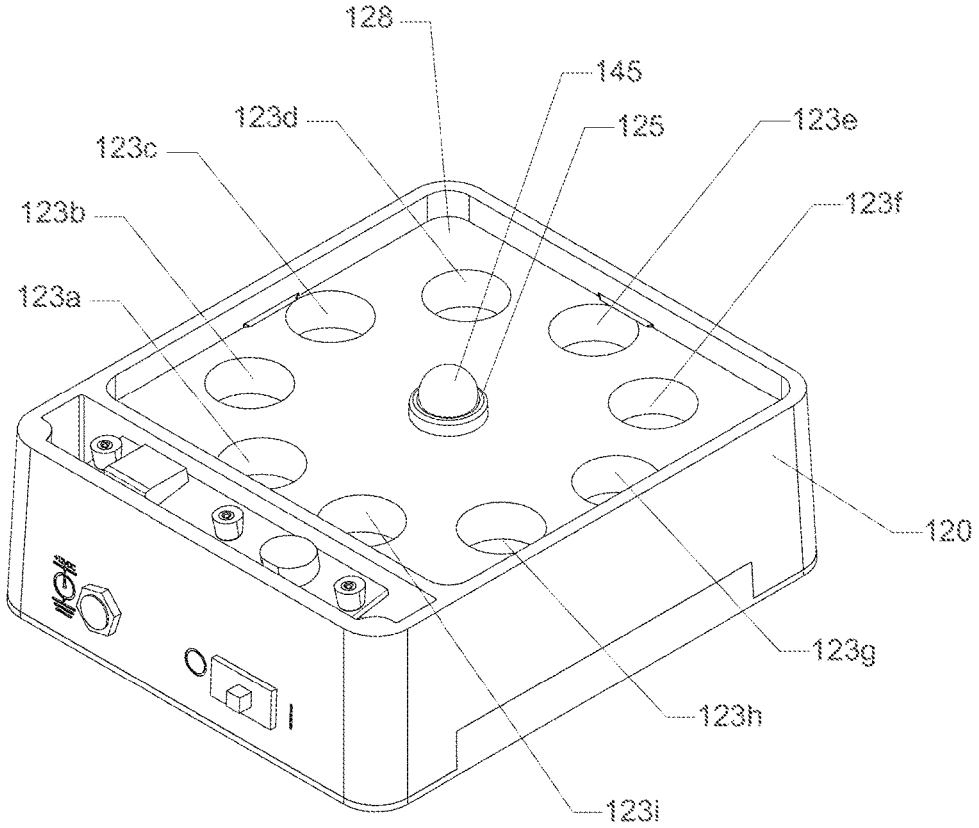
FIG. 9 is a perspective view diagram illustrating an exemplary vibratory device in accordance with some embodiments of the present invention, wherein a platform has been removed.

Although the vibratory device illustrated in FIG. 3 is shown containing four magnetic members 43*a-d* engaged with base 20, it is to be appreciated that any number of magnetic devices may be provided in accordance with some embodiments of the present invention. It is also to be appreciated that, while although the vibratory device illustrated in FIG. 3 has rectangular placement of magnetic members 43*a-d* within top cavity 28, other placements are contemplated in accordance with some embodiments of the present invention. In such embodiments, there may be four magnets in the platform in square pattern, or there may be some other number of magnets therein (e.g., 1-20 magnets) in any number of patterns (e.g., triangular, polygonal, oval, a row arrangement, etc.). As an example and without limiting the invention, FIG. 9 illustrates a vibratory device in accordance with some embodiments in which there are nine magnetic members—143*a-i* in magnetic recesses 423*a-i* in the top cavity 128, arranged in a circular pattern. In some non-limiting implementations, a vibratory device having one degree of movement and can include one magnetic member engaged with the base and one corresponding magnetic member engaged with the platform. In some other embodiments, a vibratory device having two degrees of movement can include two magnetic members engaged with the base and two corresponding magnetic members engaged with the platform. It is to be appreciated that other numbers and placements of magnetic members are contemplated in accordance with some embodiments of the present invention.

In some non-limiting implementations, and as discussed herein, the magnetic members in the base and/or platform may comprise electromagnets, each of which may generate magnetic fields having magnitudes controlled by circuitry. The electromagnets may be activated in different patterns by a control circuitry to cause the platform and the bobble head thereon to undergo different patterns of motion. Additionally, the polarity of the electromagnets may be changed, allowing the bobble toy to be cyclically attracted and repelled by the electromagnets in the base. In such embodiments, each electromagnet may have positive and negative leads from a control circuitry on each side or end of the magnet through which current can be supplied in an alternating pattern. For example, and without limiting the invention, side to side motion may be induced in the platform 30 shown in FIG. 6 by alternating activation of the lateral magnetic members 43*b* and 43*d* in sequence, thereby attracting or repelling corresponding lateral magnetic members 44*b* and 44*d* engaged with platform 30 depending on the polar arrangement of the magnets. As a further non-limiting example, platform 30 may be caused to undergo a circular motion (e.g., precession-like motion) by the sequential activation of the lateral magnetic members 43*a*-43*d*. A control circuitry may activate each of the magnetic members 43*a*-43*d* independently (e.g., without simultaneous activation of any two magnets) and for a limited period of time (e.g., from about 1 to about 2 seconds, from about 0.01 to about 1 second, about 0.1 seconds, etc.), thereby attracting or repelling corresponding platform magnetic members 44*a*-44*d* in sequence and causing the circular motion or rotation of the platform.

Figure 10:
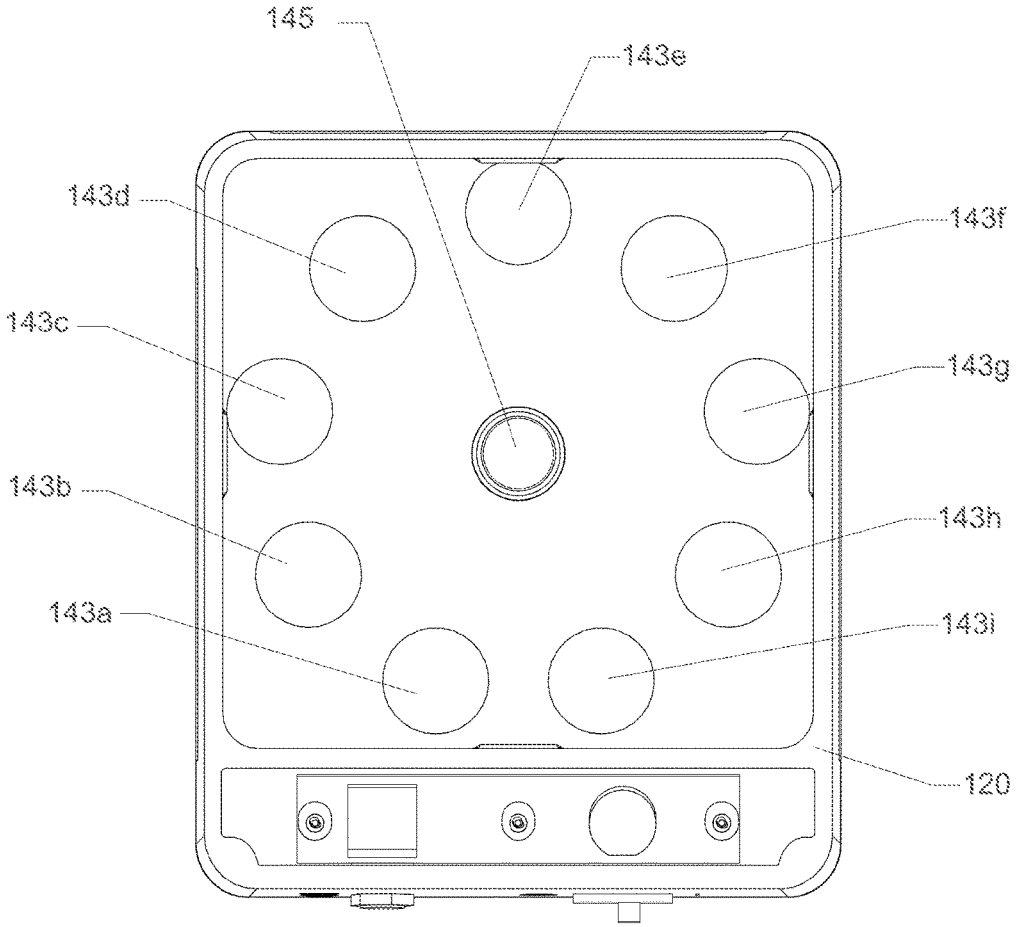
FIG. 10 is a top view diagram of a base of an exemplary vibratory device in accordance with some embodiments of the present invention, corresponding to the diagram of FIG. 9.
Figure 11:
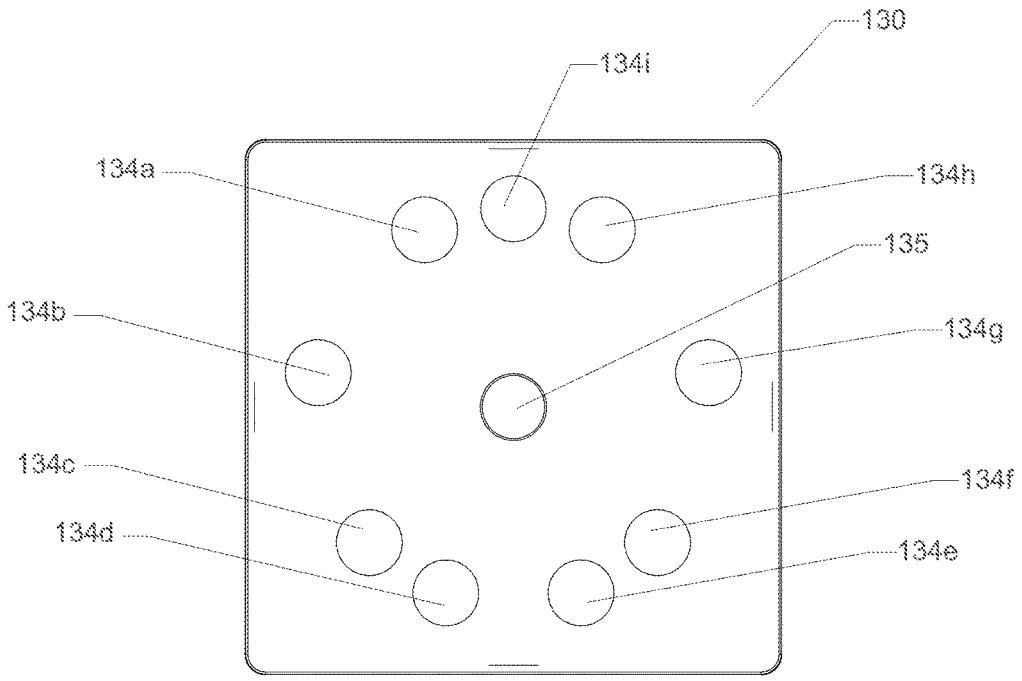
FIG. 11 is a bottom view diagram of a platform of an exemplary vibratory device in accordance with some embodiments of the present invention.
Figure 12:
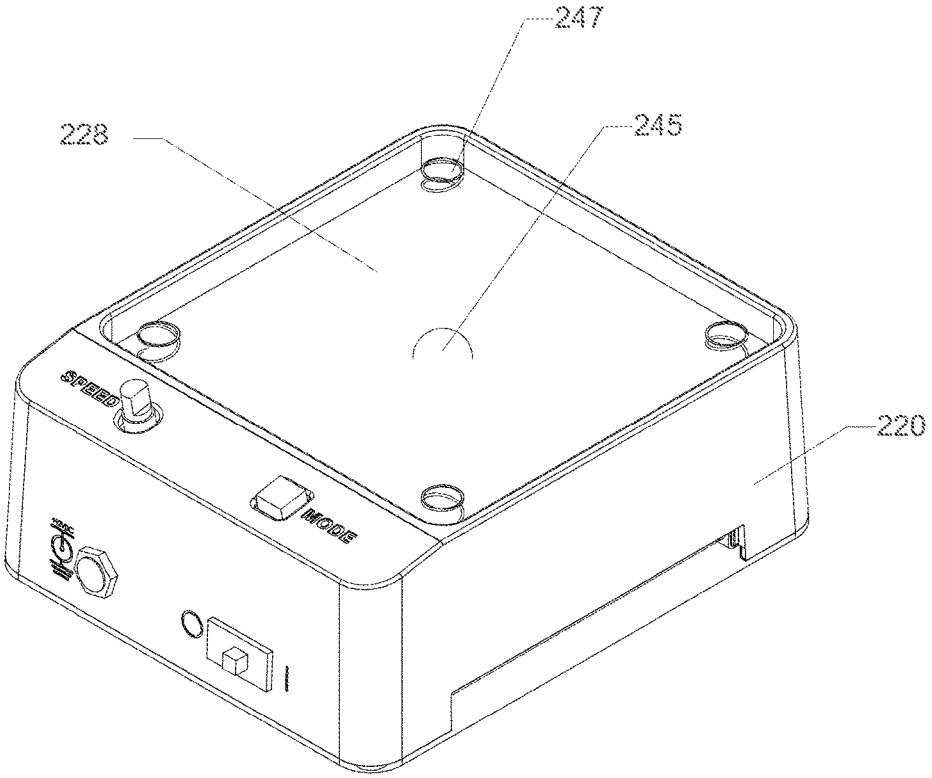
FIG. 12 is a perspective view diagram illustrating an exemplary vibratory device in accordance with some embodiments of the present invention, wherein a platform has been removed.
Figure 13:
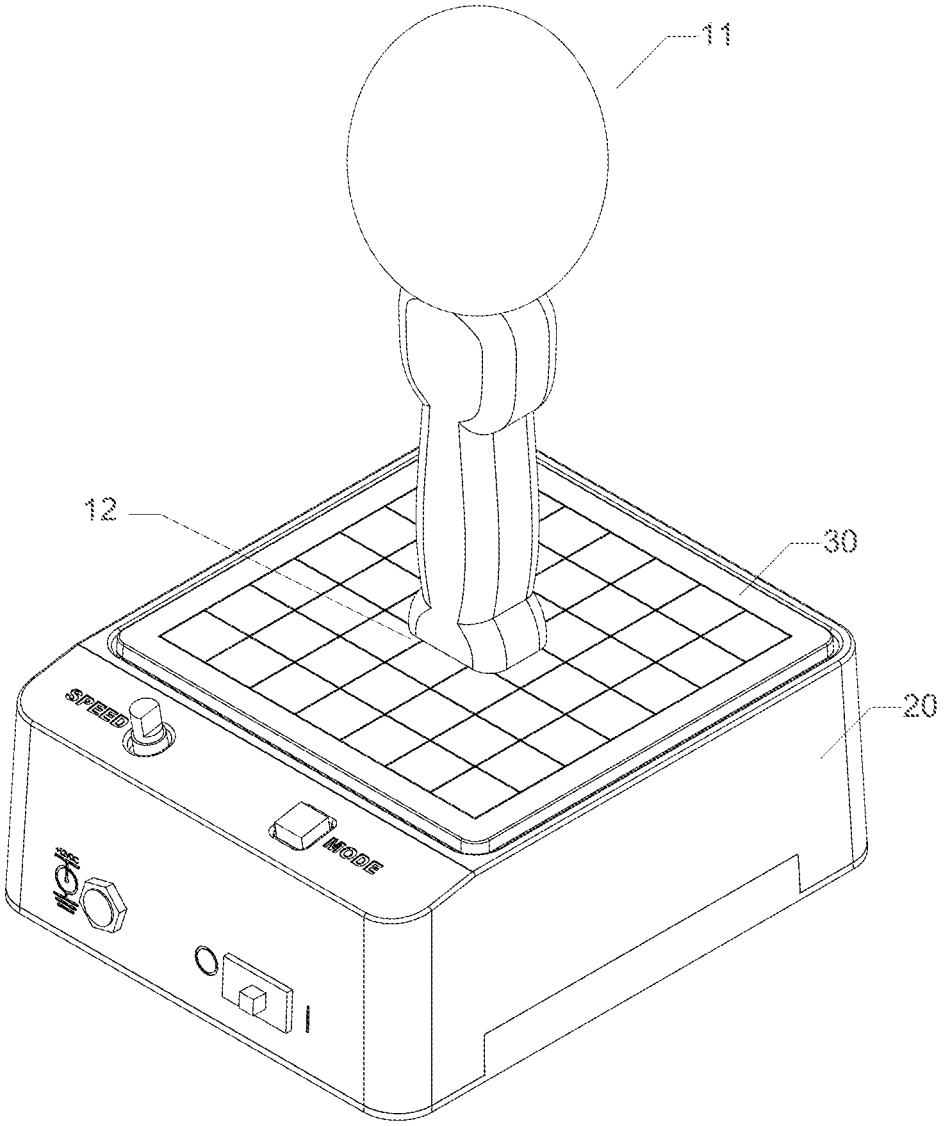
FIG. 13 is a perspective view diagram illustrating an exemplary vibratory device in accordance with some embodiments of the present invention.

It is to be appreciated that various numbering and arrangements of magnetic members in the base and/or platform may enable vibratory devices having any number of rotational/vibrational axes, and in varying resolutions. In some embodiments, the base and the platform may have the same number of magnetic elements which are aligned with each other. For example, and without limitation, the base may include for magnets and the platform may include four corresponding magnets engaged therewith in a pattern similar to that of the base magnets (e.g., base 20 and platform 30 of FIGS. 4-5 each have magnets arranged in a similar pattern around a central axis). In other embodiments, the base and the platform may have the same number of magnetic elements but at least one magnet in the base may be unaligned with at least one magnet engaged with the platform. For example, and without limitation, the base may include nine evenly spaced magnets and the platform may include nine unevenly spaced magnets engaged therewith (e.g., as shown in FIGS. 10-11, the magnets in the platform 130 may be arranged in a different pattern then the magnets in the base 120). In some embodiments, the base and platform may have differing number of magnets. For example, and without limitation, the base may include nine magnets and the platform may include five magnets.

It is to be understood that other arrangements of magnets in both the base and the platform are included in the present invention. For example, and without limiting the invention, magnets may be arranged in rows, shapes (e.g., triangle, rectangle, oval, etc.). There may be differing numbers of magnets in the base of the vibratory device and the platform. Also, the arrangements of magnets in the base may be either aligned or offset with regard to the magnets in the platform. Furthermore, control circuitry may be operable to activate electromagnets in the base and/or the platform in various patterns, allowing the platform to move in various patterns, including vertical shaking, circular movements, swaying, tilting, popping, depressing, twisting, rotating, and various other motions.

The circuitry may comprise hardware and/or software and may be responsive to one or more inputs. For example, and without limitation, the vibratory device may include switch 53 (which in some implementations may be used to turn the vibratory device on and off), button 55 (which in some implementations may be used as a mode select or program button, e.g., to change a pattern of activating electromagnets in the base and/or platform, and a consequent vibrational pattern), and/or dial 57 (which in some implementations may be used to control the vibrational speed and/or intensity). The vibratory device may also have one or more power ports, for example and without limitation, power port 51. As discussed above, the vibratory devices may also include one or more communication ports for programming, customizing, or synchronizing the vibratory devices (not illustrated).

In some embodiments, the control circuitry may be configured to selectively activate and deactivate the electromagnets according to at least one vibration pattern. For example, and without limitation, the control circuitry may include a first pattern for sequentially activating each electromagnet at a first cycle timing (e.g., sequentially pulse electromagnets 43*a-d*) to impart a circular wobbling effect on the bobble toy.

The control circuitry may also include additional patterns for sequentially activating each electromagnet at longer or shorter cycle timings to impart faster or slower wobbling. In some other examples, the control circuitry may include a first pattern for cyclically activating first and second groups of electromagnets (e.g. sequentially pulse electromagnets 43*b* and 43*d* for a one second interval to achieve side to side rocking and then sequentially pulse electromagnets 43*a* and 43*c* for a one second interval to achieve front to back rocking). In some embodiments, the multiple patterns may correspond to order of activation/deactivation amongst the electromagnets. In some embodiments, one or more switches, dials, buttons, or other configuration devices may be coupled to the control circuitry for adjusting the cyclical speed.

In some embodiments, the control circuitry may be responsive to one or more external stimuli sensors (for example and without limitation, audio sensors or light sensors) for selecting the pattern of rotation. For example and without limitation, a light sensor coupled to the control circuitry may detect low light conditions and cause the control circuitry to selectively activate and deactivate the electromagnets at a slow speed, whereas in bright light conditions the control circuitry may activate and deactivate the electromagnets at a fast speed. In some other embodiments, the control circuitry can be responsive to one or more audio ports (such as a headphone jack) such that a user may connect a conventional stereo or media player to the vibratory device and the bobble toy may vibrate in response thereto.

In some embodiments, the speakers and/or lighting devices (for example and without limitation, bulbs, LEDs, lasers, mirrors, and/or fiber optics) may be responsive to the control circuitry, which may play sounds, music, or other melodies, and activate and deactivate light sources. It is to be appreciated that in some examples, without limitation, the vibratory device may cause the bobble toy to vibrate at fast speeds, quickly activate one or more light sources, and play fast music to give the bobble toy the appearance of dancing to, for example, disco music, while alternatively causing the bobble toy to vibrate or rock at slow speeds, with a fixed light source, and play slow music to give the bobble toy the appearance of dancing to slow rhythm and blues music. Of course, other programs and patterns of the electromagnets, speakers, and/or lighting devices are contemplated in accordance with some embodiments of the present invention.

In some embodiments, the control circuitry of the vibration device may communicate with a computer, mobile phone, or other programming device to allow a user to customize the pattern of electromagnetic activation/deactivation, and optionally if such features are provided, the speakers and/or lighting devices. The programming device may communicate through a port provided in the vibration device and store in a memory element in the vibratory device a set of programs or instructions operable by a processor or controller of the control circuitry. In some implementations, the port can be USB port(s), network port(s), audio jack(s), serial port(s), parallel port(s), transceiver(s) for wireless data exchange over short distances using short wavelength radio transmissions, wireless local area network transceiver(s), and/or infrared port(s), however other ports are contemplated herein. In some other examples, the programs may be included in portable storage disks such as USB memory drives, memory sticks, multimedia cards, secure digital cards, smart media cards, picture cards, or any other type of storage drives.

Figure 4:
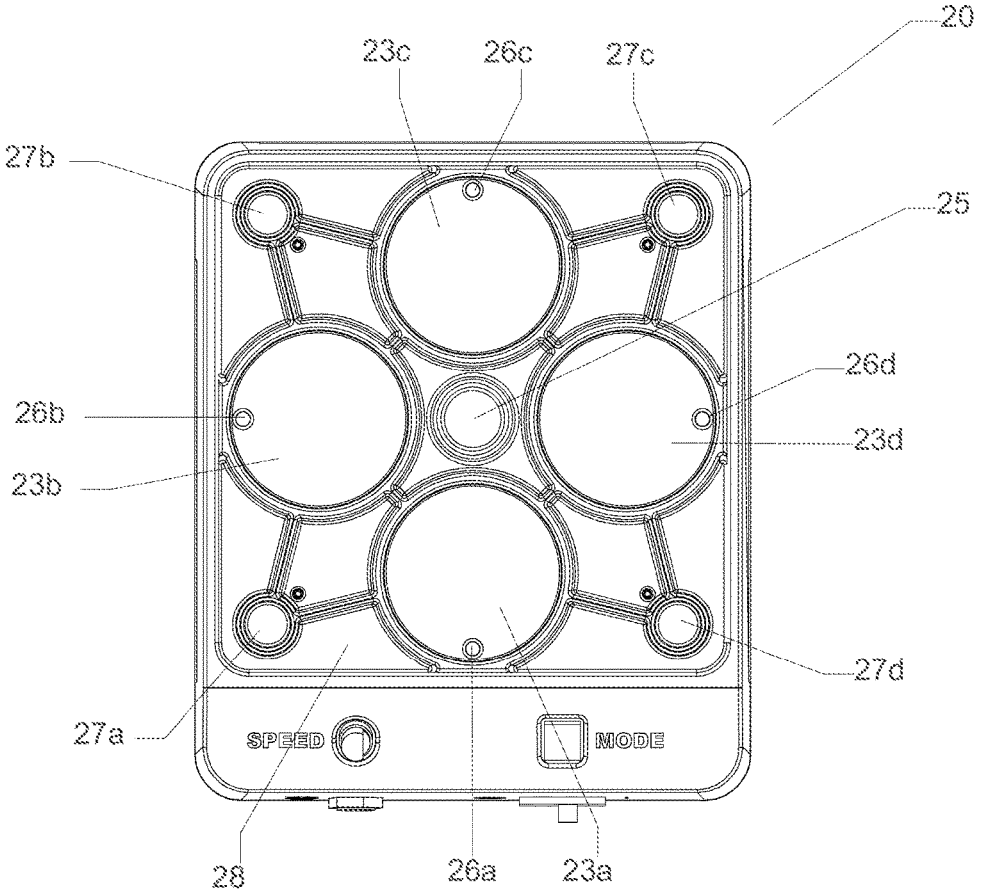
FIG. 4 is a top view diagram of a base of an exemplary vibratory device in accordance with some embodiments of the present invention, corresponding to the diagram of FIG. 3.

Referring now specifically to the illustration of FIG. 4, in some embodiments the base may include a top cavity having one or more structural elements for receiving and securing various magnetic member(s), bearing(s), and spring(s). In some non-limiting implementations, magnet recesses 23*a-d* may be provided in top cavity 28 of base 20 for receiving magnetic members (for example, and without limitation, magnetic members 43*a-d* as illustrated in FIG. 6).

It is to be appreciated that magnet recesses 23*a-d* may have a shape and size situated for receiving and securing the magnetic members of various shapes and sizes therein. In some embodiments, the top cavity of the vibratory device may have a different number and arrangements of recesses. As an example, and without limiting the invention, FIG. 9 shows a vibratory device having recesses 123*a*-123*i* arranged in a circular pattern arranged close to the edge of the top cavity 128. Preferably, but without limiting the scope of the invention, the magnet recesses are provided along outside edges of the base. In some non-limiting implementations (and as shown in FIG. 4) wherein magnetic members 43*a-d* comprise electromagnetics, wire openings 26*a-b* may be included in a bottom wall of magnet recesses 23*a-d*, respectively, such that coil wires may be inserted therein and attach to circuitry below the bottom wall of top cavity 28. It is to be appreciated however, that in some embodiments, the magnetic members in the base 220 may be provided below a flat upper surface in top cavity 228 such that the magnetic members are hidden or otherwise inaccessible.

In some embodiments, a vibratory device can include a bearing for hingedly supporting the platform during vibration. Referring back to the exemplary illustrations of FIGS. 3-6, in some implementations, socket 25 for receiving a bearing (for example, and without limitation, bearing 45 as illustrated in FIG. 6) may be positioned in top cavity 28 of base 20. Preferably the bearing (and thus socket) is centrally located and equidistant from magnet recesses 23*a-d*. It is to be appreciated that in some other embodiments of the present invention, a spring or hinge may be centrally provided for supporting the platform during vibration. Thus, in some implementations, a centrally located socket may be provided wherein a central spring or rod may be inserted. It is to be appreciated that the supporting socket (for example, and without limitation, socket 25) may have a shape and size situated for receiving and securing a bearing, hinge, spring, or rod therein. It is to be appreciated that in some embodiments, the bearing may be positioned within a socket (for example, and without limitation, bearing 145 of FIG. 9 may be positioned in socket 125), however in some other embodiments the bearing may be integrally formed with a portion of the base (for example, and without limitation, bearing 245 of FIG. 12 may be a protrusion in top portion 228).

Other recesses for receiving platform supporting elements may be provided in the top cavity of the base in accordance with some embodiments of the present invention. In some implementations, spring recesses 27*a-d* for receiving supporting springs (for example, and without limitation, springs 47*a-d* as illustrated in FIG. 6) may be positioned in top cavity 28 of base 20. Preferably, the springs (and thus recesses) are located along outside edges or corners of the top cavity of the base. In some examples, the spring recesses in the base may be closed, confining a portion of the supporting spring, e.g., to prevent the bottom portion of the supporting springs from moving within the spring recesses. However, in other examples and as shown in the exemplary illustration of FIG. 4, the spring recesses in the base may be open, i.e., allow the bottom portion of the supporting springs to move within the spring recesses. It is to be appreciated that in some embodiments, the springs may be provided and secured within recesses in the top portion of the base, however in some other embodiments the springs may be provided and secured within a bottom surface of the platform.

It is to be appreciated that any number of magnet recesses, sockets, or spring recesses, and other locations, sizes, and combinations thereof are contemplated in accordance with some embodiments of the present invention. For example, and without limitation, a vibratory device may comprise only two magnet recesses for receiving two magnetic members therein. In some other examples, a vibratory device may be standardized and include four magnet recesses but only two of such magnet recesses may be populated with magnetic members therein. Thus, it is to be appreciated that the same base may be used for different vibratory device models, some of which may include one degree of movement and some of which may include two degrees of movement. In other non-limiting examples, magnet recesses may be provided in each of four corners of the top cavity of the base and spring recesses may be provided along the edges of the top cavity of the base. In some other non-limiting examples, a single magnet recess may be centrally provided, and a single magnetic member may be placed therein for enabling up and down vibratory motion to the platform.

Figure 5:
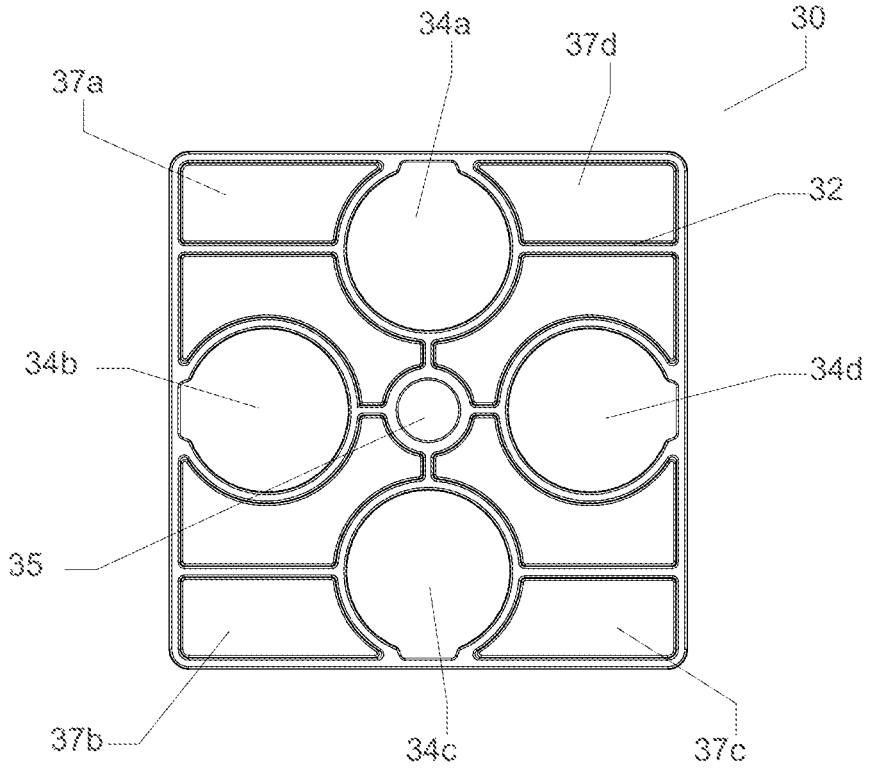
FIG. 5 is a bottom view diagram of a platform of an exemplary vibratory device in accordance with some embodiments of the present invention.

Referring now specifically to the illustration of FIG. 5, it can be seen that a bottom surface of the platform 30 may also include one or more structural elements for receiving and securing the various magnetic member(s), bearing(s), and spring(s). It is to be appreciated that in preferred embodiments, the structural elements provided on the bottom surface of the platform have numbers, locations, sizes and combinations thereof which are complementary to the structural elements provided in the top cavity of the base (e.g., the structural elements of the platform may mirror the structural elements in the base), such that one or more magnetic members, springs, bearings, or hinges may be perpendicularly positioned relative to the bottom surface of the platform and the bottom wall of the top cavity of the base. For example, and without limitation, the platform may include magnetic recesses that are aligned directly above magnetic recesses in the base. However in some other embodiments, and as illustrated in the examples of FIGS. 9-11, one or more structural elements of the base may not be aligned with corresponding structural elements of the platform.

In some implementations, and referring back to the example of FIG. 5, bottom surface 32 of platform 30 may include magnet recesses 34*a-d* for receiving magnetic members (for example, and without limitation, magnetic members 44*a-d* as illustrated in FIG. 6). Although there are four magnet recesses 34*a-d* illustrated in FIG. 6, each having a circular shape, it is to be appreciated that the present invention includes magnet recesses in the platform having other shapes, numbers, and various other characteristics. In some implementations, bottom surface 32 may include socket 35 for receiving a bearing (for example, and without limitation, bearing 45 as illustrated in FIG. 6). In some other implementations (not illustrated), a centrally located socket may be provided in the bottom surface of the platform wherein a central supporting spring or rod may be inserted. In some implementations, spring recesses 37*a-d* for receiving supporting springs (for example, and without limitation, springs 47*a-d* as illustrated in FIG. 6) may be positioned in bottom surface 32 of platform 30. In some examples, the spring recesses in the platform may be open, i.e., allow the top portion of the supporting springs to move within the spring recesses. It is to be appreciated that any number of magnet recesses, sockets, or spring recesses, and other locations, sizes, shapes, and combinations thereof are contemplated in accordance with some embodiments of the present invention, which may be generally analogous to the variations and permutations as discussed with reference to the magnet recesses, sockets, and spring recesses of the base.

Referring now specifically to the exemplary illustration of FIG. 6, it can be seen that in preferred embodiments, a plurality of magnets and springs may be positioned between the base and the platform for supporting and imparting vibration thereto. Base 20 may include main body 21 having top cavity 28 formed therein. Top cavity 28 may include magnet recesses 23*a-d*, may include socket 25, and may include spring recesses (such as spring recesses 27*a-d* as better viewed and identified in FIG. 4). Platform 30 may include top surface 31 (which may include gripping or other surface features 39) and bottom surface 32. Platform 30 may include bottom surface 32 which, and as better viewed and identified in FIG. 5, may include magnet recesses 34*a-d*, may include socket 35, and may include spring recesses 37*a-d*.

In some embodiments of the present invention, vibratory motion may be imparted to the platform by attractive and/or repulsive magnetic forces applied between a plurality of magnetic members engaged with the base and platform. In some embodiments, one or more of the magnetic members engaged with the base and one or more of the magnetic members engaged with the platform may comprise rare earth magnets, permanent magnets, ferromagnetic material, or electromagnets. In some preferred implementations, one or more of magnetic members 43*a-d* in the base may comprise electromagnets each of which may be selectively activated and deactivated to induce a magnetic field upon which one or more of magnetic members 44*a-d* of the platform may react. In some implementations, all of the magnetic members in the base and/or platform may comprise the same type of magnetic members (for example, and without limitation, all of the base magnetic members may include electromagnets while all of the platform magnetic members may comprise rare earth magnets). However in other implementations, multiple types may be provided. For example, and without limitation, magnetic members 43*a* and 43*b* may comprise electromagnets and magnetic members 43*c* and 43*d* may comprise permanent magnets. It is further to be appreciated that one or more of magnetic members 43*a-d* may comprise a ferromagnetic material that may attract or repel one or more of magnetic members 44*a-d*. It is to be appreciated that other combinations of magnetic members in the base and/or platform are contemplated in accordance with some embodiments of the present invention.

As illustrated in the non-limiting examples of FIGS. 4-6, magnetic members 43*a-d* may be positioned and secured in magnet recesses 23*a-d* of base 20, respectively, and opposing and corresponding magnetic members 44*a-d* may be positioned and secured in magnet recesses 34*a-d* of platform 30, respectively. The arrangement of the magnetic members 44*a-d* in the platform 30 may mirror the arrangement of magnetic members 43*a-d* in the base 20. Such an arrangement allows the magnetic members 43*a-d* (e.g., electromagnets) to repel or attract magnetic members 44*a-d* (e.g., permanent magnets). As an example of the operation of the vibratory device, magnetic members 43*a-d* may be electromagnets that can be activated by a control circuitry when the vibratory device is turned on with switch 53. One or more of the magnetic members 43*a-d* may activated at one time and repel magnetic members 44*a-d* (e.g., permanent magnets) causing one or more sides of the platform to rise. The springs 47*a-d* may hold the platform 30 in position as it is repelled by the magnetic members 43*a-d*. In another example of the operation of the vibratory device, the magnetic members 43*a-d* may be electromagnets that, when activated, attract the magnetic members 44*a-d*, depressing one or more sides of the platform toward the base. The springs 47*a-d* may hold the platform in position as it is attracted to the magnetic members 43*a-d*, and prevent the magnetic members 44*a-d* from contacting magnetic members 43*a-d*. In some embodiments, cyclically (i) the magnetic member 43*a* may be activated to attract magnetic member 44*a* and magnetic member 43*c* may be activated to repel magnetic member 44*c* and (ii) the magnetic member 43*a* may be activated to repel magnetic member 44*a* and magnetic member 43*c* may be activated to attract magnetic member 44*c*, thus causing forward and backward vibrational "rocking" of the platform.

Springs 47*a-d* may have first ends positioned and secured in spring recesses 27*a-d* of base 20, respectively, and second ends positioned in spring recesses 37*a-d* of platform 30, respectively. Bearing 45 may be positioned between socket 25 of base 20 and socket 35 of platform 30. It is to be appreciated that, in some embodiments as illustrated in the examples of FIGS. 3-6, a centrally located bearing or pivot, distal springs, and intermediate positioned magnets may enable vibration having a focal point of the center of the platform, which may be dampened by springs.

In some embodiments, one or more preventative dampeners (for example, and without limitation, foam or rubber pads) may be provided between the magnetic members engaged with the base and the magnetic members engaged with the platform for preventing unintended direct contact of the magnetic members during operation. As an example and without limiting the invention, FIG. 6 shows dampeners 49*a-d* may be attached to magnetic members 43*a-d* and/or magnetic members 44*a-d*.

In preferred implementations, each of magnetic members 43*a-d* may comprise an electromagnetic and each of magnetic members 44*a-d* may comprise rare earth magnets, permanent magnets, or ferromagnetic material. It is to be appreciated that alternating activation of electromagnetic members 43*a* and 43*c* may induce alternating magnetic fields on magnetic members 44*a* and 44*c*, respectively, which may impart a front-to-back vibration of platform 30. Similarly, it is to be appreciated that alternating activation of electromagnetic members 43*b* and 43*d* may induce alternating magnetic fields on magnetic members 44*b* and 44*d*, respectively, which may impart a side-to-side vibration of platform 30. Further, it is to be appreciated that sequential activation of electromagnetic members 43*a-d* may induce magnetic fields on magnetic members 44*a-d*, respectively, which may impart a circular vibration of platform 30. It is further to be appreciated that alternating activation of (i) two adjacent electromagnet members (e.g., 43*a* and 43*b*) and (ii) the other two adjacent electromagnetic members (e.g., 43*c* and 43*d*) may impart a corner-to-corner vibration of platform 30.

In some other examples, two adjacent magnetic members (e.g., 43*a* and 43*b*) may comprise an electromagnet and two other adjacent magnetic members (e.g., 43*c* and 43*d*) may comprise permanent magnets. It can be appreciated that pulsing of electromagnetic member in a front of the base (e.g., 43*a*) may impart a front-to-back vibration on the platform (e.g., platform 30) and pulsing of an electromagnetic member (e.g., 43*b*) located on a lateral side of the base (e.g., base 20) may impart a side-to-side vibration on the platform. In some other non-limiting examples, magnetic members in the base (e.g., magnetic members 43*a-d*) may comprise permanent magnets and magnetic members in the platform (e.g., magnetic members 44*a-d*) may comprise electromagnets. In some other non-limiting examples, at least one of the magnetic members in the base (e.g., 43*a-d*) may comprise an electromagnet and at least one of magnetic members in the platform (e.g., 44*a-d*) may comprise an electromagnet. It is to be appreciated that other combinations of electromagnets, permanent magnets, rare earth magnets, and ferromagnetic material are contemplated in accordance with some embodiments of the present invention.

It is to be appreciated that a bearing (e.g., bearing 45) can be centrally located in the top cavity of the base that permits hinged movement about the center of the magnetic members (e.g., magnets 43*a-d*) and/or platform (e.g., platform 30). As such, a bobble toy positioned on the platform may appear to bobble or wobble. In some embodiments, a vibratory device can instead have a centrally located spring in a spring recess in the center of a top cavity (e.g., top cavity 28) of the base. In such non-limiting embodiments, and in those where magnetic members (e.g., magnets 43*a-d*) in the base comprise electromagnets, simultaneous activation of the electromagnetic members may induce upward and downward vibration on the platform (e.g., platform 30).

In some embodiments, the supporting springs (e.g., springs 47*a-d*) may be interchangeable. For example, and without limitation, springs having heavier weights may be used when heavier bobble toys are placed on the platform and springs having lighter weights may be used when lighter bobble toys are placed on the platform. It is to be appreciated that providing springs having different weights enable different platform vibration characteristics.

It is to be appreciated that vibratory devices in accordance with embodiments of the present invention may comprise any number, location, and type of magnetic members, springs, and bearings. Those skilled in the art can appreciate that the number and positioning of magnetic members, relative to each other and to a central bearing (if present) may enable a multitude of different vibration patterns.

In some embodiments, the base may have a bottom cavity for housing circuitry, power sources, control devices, ports, inputs, audio speakers, microphones, display lighting, and other elements. Referring now specifically to the illustration of FIG. 7, in some embodiments the base may have a bottom cavity 29 for housing a circuit board 61, a light 67, and auxiliary board 62 on which button 55 and dial 57 are installed. In some non-limiting implementations, base 20 can include main body 21 and bottom panel 22 forming bottom cavity 29 there between. In some non-limiting implementations, bottom panel 22 can be substantially flat such that when assembled it is flush with a bottom edge of main body 21. However, in other non-limiting implementations, and as shown in the exemplary illustration of FIG. 7, main body 21 can be elevated relative to bottom panel 22*a*.

Figure 7:
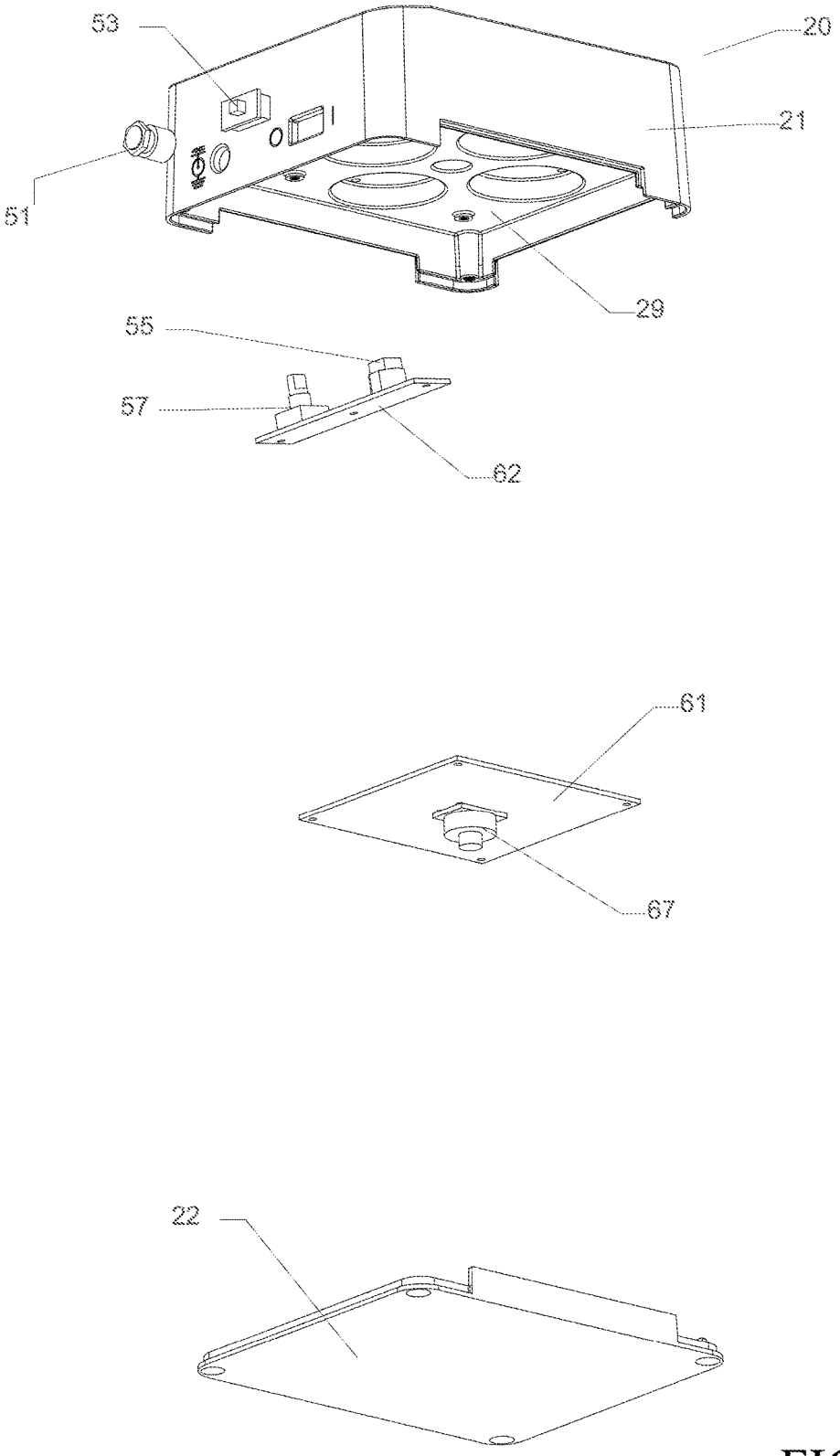
FIG. 7 is an exploded bottom perspective view diagram of an exemplary vibratory device in accordance with some embodiments of the present invention.
Figure 8:
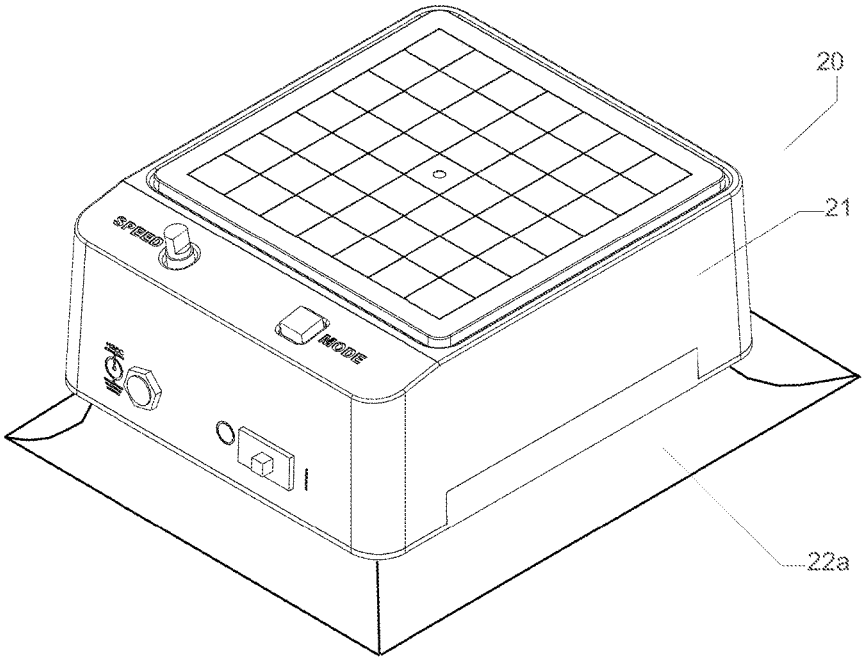
FIG. 8 is a perspective view diagram illustrating an exemplary vibratory device in accordance with some embodiments of the present invention.

In some non-limiting implementations, the main body (e.g., body 21) can have one or more openings on side or top walls for receiving user inputs therein. For example, and without limitation, FIGS. 3 and 7 show a main body 21 that may include openings through which port 51, switch 53, button 55, and dial 57 may extend. It is to be appreciated that in some implementations, inputs may be mounted to circuitry boards (for example, and without limitation, auxiliary board 62). A primary circuit board (e.g., circuit board 61) may be positioned and secured within the bottom cavity (e.g., bottom cavity 29). In some non-limiting embodiments, the primary circuit board may include electronic components, microprocessors, speakers, and/or power supplies (for example, and without limitation, batteries) for controlling the vibratory device. The control circuitry for the vibratory device may include the auxiliary and main circuit boards. It is to be appreciated that vibratory devices may be powered from any source, including but not limited to batteries, residential alternating current electricity, direct current electricity converted from residential alternating current electricity, solar panels, powered local area networks, and powered computer ports.

In some non-limiting embodiments, the vibratory device may include one or more aesthetic display lights for increasing the enjoyment of the user during operation. Vibratory devices may include multiple lights having multiple different colors. In some non-limiting implementations, lights may be positioned on an outside surface of the vibratory device on walls of the base and/or the platform. In some non-limiting implementations, lights may be internally positioned and configured to shine light through one or more openings in, or translucent surfaces of, the base or housing. For example, and without limitation, FIG. 7 shows a light 67 that may be mounted to circuit board 61 and bottom panel 22 may have a translucent bottom or side panels through which the light may shine. In some non-limiting implementations, fiber optic cabling can transmit the light from lights in the base (e.g., light 67) through surfaces of the base (e.g., base 20) and/or the platform (e.g., platform 30). For example, and without limitation, fiber optics may be used to give the base and/or the platform the aesthetics of changing color, or displaying text and/or graphics, which may be configured or programmed by the user. In some non-limiting implementations, the vibratory device may include a laser and positionable mirror for projecting text and/or images on a translucent surface of the base and/or platform. In some other non-limiting implementations, and as shown in the exemplary illustration of FIG. 8, the main body 21 of base 20 may be elevated above bottom panel 22*a*, and bottom panel 22*a* may a curved reflective or mirrored surface for reflecting light generated within main body 21. It is to be appreciated that the base may have additional windows (e.g., cut-outs or translucent areas) and light-producing devices (e.g., a rotating LED light source operable to produce multiple colors) provided in various arrangements to provide aesthetic effects.

CONCLUSION/SUMMARY

The present invention thusly provides apparatuses and systems for enabling silent and maintenance free autonomous motion on bobble toys. In embodiments comprising electromagnets, programmable and/or customizable vibration patterns may be provided allowing the user to create their own vibration program or pattern.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is to be understood that variations, modifications, and permutations of embodiments of the present invention may be made without departing from the scope thereof. Thus, although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A vibratory device for imparting motion to a bobble toy comprising:

a) a base having at least two base magnetic members in a fixed position therein, each said base magnetic member comprising at least one electromagnet;

b) a platform for supporting a bobble toy, said platform having at least two platform magnetic members engaged therewith, wherein each of said platform magnetic members are disposed adjacent to at least one of said base magnetic members;

c) at least two support springs for supporting said platform, each said support spring between said base and a bottom surface of said platform;

d) a socket positioned about equidistant from each of said at least two support springs;

e) a bearing positioned near the center of said platform for supporting said platform, said bearing between said base and a bottom surface of said platform and received in said socket, said bearing about equidistant to each of said base magnetic member; and f) control circuitry adapted to selectively activate and deactivate said electromagnets to induce a pattern of vibration of said platform relative to said base.

2. The vibratory device of claim 1, said base magnetic members operable to displace said platform magnetic member.

3. The vibratory device of claim 1, wherein at least one of said platform magnetic members comprises at least one magnet selected from the group consisting of a rare earth magnet and a permanent magnet.

4. The vibratory device of claim 1, wherein at least one of said platform magnetic members comprises at least one electromagnet.

5. The vibratory device of claim 1, further comprising at least one of the group consisting of a configuration device, a port, and a sensor coupled to said control circuitry adapted to activate and deactivate said electromagnets.

6. The vibratory device of claim 1, further comprising a bobble toy detatchably engaged to said platform.

7. The vibratory device of claim 1, further comprising a bobble toy, wherein said bobble toy comprises said platform, and said at least one platform magnetic member is in a base of said bobble toy.

8. The vibratory device of claim 1, wherein each of said platform magnet members are selected from the group consisting of a rare earth magnet and a permanent magnet.

9. The vibratory device of claim 1, wherein each of said platform magnet members comprise a ferromagnetic material.

10. The device of claim 1, said bearing comprising a ball.

11. The device of claim 10, said socket having a first portion in said bottom surface of said platform.

12. The device of claim 11, said socket having a second portion in an upper surface of said base.

13. The device of claim 10, said ball integrally formed in an upper surface of said base.

14. The device of claim 10, said ball integrally formed in said bottom surface of said platform.

15. A vibratory device for imparting motion to a bobble toy comprising:

a) a platform for supporting a bobble toy;
b) a base supporting said platform;
c) a first plurality of magnetic members engaged with said platform near peripheral edges thereof;
d) a second plurality of magnetic members in a fixed position in said base near peripheral edges thereof, wherein each of said second plurality of magnetic members comprises an electromagnet, and wherein each of said first plurality of magnetic members is aligned with one of said second plurality of magnetic members;
e) a plurality of support springs supporting said platform, wherein first ends of said support springs engage said base and second ends of said support springs engage said platform;
f) a socket about equidistant from each of said first plurality of magnetic members, about equidistant from each of said second plurality of magnetic members, and about equidistant from each of said plurality of support springs;
g) a bearing for supporting said platform, said bearing between said base and a bottom surface of said platform and received in said socket; and
h) control circuitry adapted to selectively activate and deactivate said electromagnets to induce a pattern of vibration of said platform relative to said base.

16. The vibratory device of claim 15, further comprising at least one configuration device coupled to said control circuitry adapted to select a pattern in which said at least one electromagnet is selectively activated and deactivated.

17. The vibratory device of claim 16, further comprising at least one speaker coupled to said control circuitry, said at least one configuration device further adapted to select a pattern of sound emitted from said at least one speaker.

18. The vibratory device of claim 16, further comprising at least one light source coupled to said control circuitry, said at least one configuration device further adapted to select a pattern of light emitted from said at least one light source.

19. The vibratory device of claim 18, wherein at least one of said platform and said base comprises at least one member selected from the group consisting of openings, reflective material, and translucent materials, for reflecting or passing light emitted from said at least one light source.

20. The vibratory device of claim 15, further comprising at least one port coupled to said control circuitry, said at least one port for electronic communication with an external electronic device.

21. The vibratory device of claim 15, said control circuitry comprising a processor and a memory element, said memory element for storing instructions for said processor to selectively activate and deactivate said at least one electromagnet according to at least one pattern.

22. The vibratory device of claim 21, further comprising at least one port coupled to said control circuitry, said at least one port for electronic communication with an external electronic device, said control circuitry adapted to receive said instructions from said external electronic device and store said instruction in said memory.

23. The vibratory device of claim 15, further comprising at least one sensor for detecting external stimuli coupled to said control circuitry.

24. The vibratory device of claim 23, said sensor selected from the group consisting of an audio sensor and a light sensor.

25. The vibratory device of claim 15, further comprising a fastener for securing said bobble toy to said platform.

26. The device of claim 15, said bearing comprising a ball.

27. The device of claim 15, said socket in said bottom surface of said platform.

28. The device of claim 15, said socket in an upper surface of said base.

29. The vibratory device of claim 15, further comprising at least one port for electronic communication with an external electronic device, said control circuitry adapted to receive said instructions from said external electronic device and store said instruction in said memory.

30. A system for automating vibration of a bobble toy, said system comprising at least one vibratory device each having (i) a platform for supporting a bobble toy, said platform having a plurality of magnetic members engaged therewith, (ii) a base supporting said platform having a plurality of electromagnets in a fixed position therein, said electromagnets adjacent to said magnetic member of said platform, (iii) a bearing and a socket near the center of said platform, said bearing received in said socket (iv) a plurality of support springs, and (v) control circuitry adapted to selectively activate and deactivate said electromagnets to induce a pattern of vibration of said platform relative to said base, wherein said bearing and said socket are between said base and said platform and about equidistant from each of said plurality of magnetic members of said platform, each of said electromagnets of said base, and each of said support springs.

31. The system of claim 30, wherein said vibration pattern of said platform is selected from a plurality of vibration patterns by operation of a configuration device coupled to said control circuitry.

32. The system of claim 30, wherein said vibration pattern of said platform is selected from a plurality of vibration patterns through a port coupled to said control circuitry, said port for communication with an external electronic device.

33. The system of claim 30, comprising at least two vibratory devices, said control circuitry of a first vibratory device coupled to said control circuitry of said second vibratory device.

34. The system of claim 33, wherein said control circuitry of said first vibratory device selects a vibration pattern of said second vibratory device.

35. The system of claim 30, said vibratory device further comprising at least one light source, said control circuitry further adapted to activate and deactivate said at least one light source according to at least one pattern.

36. The system of claim 30, said vibratory device further comprising at least one speaker, said control circuitry further adapted to activate and deactivate said at least one speaker according to at least one pattern.

37. The system of claim 30, said vibratory device further comprising at least one sensor detecting external stimuli coupled to said control circuitry.

38. A vibratory device for a bobble toy comprising:
a) a base having a rectangular upper surface, said base comprising at least two electromagnets in a fixed position near the center of adjacent peripheral edges of said upper surface;
b) a rectangular platform above and parallel to said upper surface of said base, said platform having a substantially flat and horizontal upper surface for supporting a bobble toy and a bottom surface with a socket centrally located therein and at least two magnetic members positioned above said electromagnets in said base;
c) four support springs between said bottom surface of said platform and said upper surface of said base;

d) a bearing having a top portion positioned in said socket of said platform, said bearing comprising a ball;

e) control circuitry adapted to selectively activate and deactivate said electromagnets to induce a pattern of vibration of said platform relative to said base; and f) at least one configuration device coupled to said control circuitry adapted to select a pattern in which said at least one electromagnet is selectively activated and deactivated, wherein each of said support springs are about equidistant from said socket, wherein each of said electromagnets are about equidistant from said socket, and wherein each of said magnetic members are about equidistant from said socket.

* * * * *